United States Patent [19]

Rego

[11] 4,379,708

[45] Apr. 12, 1983

[54] PROCESS FOR TANNING FISH SKINS

[76] Inventor: Norberto O. S. Rego, 1145 NW. 42st St., Miami, Fla. 33127

[21] Appl. No.: 349,729

[22] Filed: Feb. 18, 1982

[51] Int. Cl.[3] ..... C14C 3/28; C14C 3/04; C14C 3/06

[52] U.S. Cl. ..... 8/94.12

[58] Field of Search ..... 8/94.12

[56] References Cited

U.S. PATENT DOCUMENTS

| | | | |
|---|---|---|---|
| 1,256,974 | 2/1918 | Bendixen et al. | 8/94.12 |
| 1,467,858 | 9/1923 | Knudsen | 8/94.12 |
| 1,725,629 | 8/1929 | Adrien | 8/94.12 |
| 2,633,730 | 4/1953 | Rose | 8/94.12 |
| 2,700,590 | 1/1955 | Biery et al. | 8/94.12 |

*Primary Examiner*—Maria Parrish Tungol

*Attorney, Agent, or Firm*—Ladas & Parry

[57] ABSTRACT

Tanned fish skins of good quality may be obtained by (a) contacting dry fish skins with an aqueous solution of a neutral salt said solution having a pH adjusted into the range 1.5 to 3.5, (b) subjecting said fish skins to a two step tanning operation wherein after said first tanning step said skins are washed at a temperature of not more than 35° C. and the second tanning step is carried out using a more concentrated solution than the first tanning step at a temperature of not less than 35° C. and (c) washing the tanned skins and treating them in an aqueous bath with an anionic grease and then an oil and then with an alkali metal salt of a weak organic acid followed by an alkali to raise the pH to at least 6.

17 Claims, No Drawings

PROCESS FOR TANNING FISH SKINS

BACKGROUND OF THE INVENTION

1. Field of the Invention

The present invention relates to the tanning of fish skins.

2. Description of the Prior Art

Up to 1930's (and indeed later in wartime Germany) there was a substantial interest in the tanning of fish skins to try to provide an alternative to animal skins for a variety of purposes, including foot wear, clothing and accessories. However, none of the processes suggested or employed were particularly successful in producing high quality items and, with the exception of shark skins which are tanned commericially, for example in Japan, there has been little or no interest in tanning of fish skins since the end of World War II.

Early suggestions for tanning of fish skins include those of U.S. Pat. Nos. 1,256,794, 1,467,858 and 2,633,730. In the process of U.S. Pat. No. 1,467,858 skins were tanned after preliminary treatments with sodium sulfide, lime and hydrochloric acid followed by bating. In the process of U.S. Pat. No. 1,467,858 fish skins were chrome tanned after treatment with lime and then acid, and after tanning the skins were treated with thiosulfate or soda. In the process of U.S. Pat. No. 2,633,730 the skins were treated with a pancreatic enzyme and then tanned with a vegetable extract, a syntan or after pickling and bleaching with a chrome tan. It is suggested that a combination of tannages, for example formaldehyde and chrome combinations may be used. French Pat. No. 729,942 abstracted in Chemical Abstracts volume 27 at column 439[8] described the tanning of fish skins with synthetic tanning agents and then with vegetable tanning agents or a mixture of the two followed by chrome tanning.

More recently one of the rare disclosures in this field has been U.S. Pat. No. 2,700,590 which teaches the use of high astringency tanning agents such as a combination of cutch extract, quebracho extract and a phenol sulfonic acid formaldehyde condensation product.

The skin structure of teleost fishes (which comprise most common species of bony fish except sturgeon) differs from that of mammals and sharks, and it is this difference which has hitherto prevented the production of satisfactory high quality tanned products from the skins of such fishes. A brief description of the peculiarities of such skins is given in U.S. Pat. No. 2,700,590. In particular, it should be noted that fish collagen is very sensitive to hydrolysis.

OBJECTS AND SUMMARY OF THE INVENTION

It is an object of my invention to provide a method for producing high quality tanned fish skins suitable for a wide variety of uses.

According to my invention, there is provided a process for the production of tanned fish skins which comprises (a) contacting dry fish skins with an aqueous solution of a neutral salt said solution having a pH adjusted into the range 1.5 to 3.5.

(b) subjecting said fish skins to a two step tanning operation wherein after the first stage said skins are washed at a temperature of not more than 35° C. and the second tanning step is carried out using a more concentrated solution then the first stage at a temperature of not less than 35° C. and (c) washing the tanned skins and treating them in an aqueous bath with an anionic grease and then an oil and then with an alkali metal salt of a weak organic acid followed by an alkali to raise the pH to at least 6.

DESCRIPTION OF PREFERRED EMBODIMENTS

Fish for use in the present invention are those which do not have scales with a diameter of more than one inch which overlap to prevent penetration of the treating chemicals. Although the process of the invention can be used for the treatment of shark skin, it finds more particular use in the treatment of skins which have not hitherto been treatable to produce high quality products, namely those of the teleost fishes. Suitable fish skins for treatment in the process of the present invention include those of the order Apodes (eels) and Percomorphi. More particularly of use on fish of the suborders Percoidea (such as croakers), Scombroidea (such as tuna and marlin) and Ophidioidea (such as cush eels). Other useful fish include: bonito, blackfish, grouper, redfish, swordfish, etc.

For use in the process of the present invention, the fish skins may be dried in any convenient way. One useful drying technique is to place raw fish skins on trays and cover them with common salt for a period of many hours, for example 24 hours and then hang the skins for completion of the drying. Alternatively, the skins may be immersed in a strong solution of common salt for say 10 to 18 hours and then hung for drying. Another possibility is simply to expose the skins to fresh air or to keep them in a warm environment (but keeping the temperature below 30° C.).

In the first stage of the process of the present invention, the skins are treated with an aqueous solution of a neutral salt such as sodium sulfate or sodium chloride at ambient temperature. The solution used has its pH adjusted into the range 1.5 to 3.5 by addition of the necessary amount of acid before being contacted with the fish skins. Any suitable acid may be employed. However, the use of an organic acid is normally to be preferred since it minimises the risk of swelling of the skins. However, if desired, one may employ an inorganic acid and if necessary a retarder to control swelling. I have found the use of formic acid to be particularly useful, for example in an amount of 0.05 to 0.5 percent by volume depending upon the exact native of the salt employed. Typically, the salt solution itself is of a concentration of from 100 to 250 grams per liter. I have often found it convenient to use from 2 to 6 liters of aqueous salt solution per kilogram of fish skins. Typically, the skins are contacted with the aqueous salt solution for from 8 to 20 hours during which time a rise in pH may occur. The final pH should be in the range 2 to 4. In this stage, any scales on the fish are removable.

For the tanning stage of my invention, I have found it particularly useful to use a combination of a chromic salt such as chromic sulfate and a syntan, for example those based on phenol sulfone condensation products. Other syntan tanning agents may be employed, however, including formaldehyde condensates with aromatic sulfonates such as naphthalene sulfonates and phenol sulfonates. Indeed in suitable cases tanning may be carried out using only a chromic salt or only a phenolic tanning agent.

The actual tanning operation is carried out in two steps. In the first step the skins are typically contacted with the tanning solution at ambient temperature for a period of from 15 to 36 hours. When using a combination of chromic sulfate and a syntan, a concentration of 0.018 to 0.032 grams per liter will normally be employed. This combination of chromic sulphate and a syntan agent comes previously combined by a different chemical companies, under several names and marks so that is not necessary to mix separate ingredients during our process. After completion of the first tanning stage, the skins are washed with water at a temperature of no more than 35° C., often typically no more than 30° C.

So far as I am aware, there has been no previous suggestion to use a combination of a chromic salt and a syntan for the tanning of fish skins.

The second tanning step is desirably carried out with the same tanning agent as is used in the first of these steps. It is, however, employed at a higher concentration and the initial temperature of the bath used is at least 35° C., often typically at least 50° C. During the second stage, the temperature is normally held in the range 40° to 50° C. When using a combination, a chromic salt and a syntan in this stage, the concentration of the chromic salt and syntan is typically in the range 0.050 to 0.090 grams/liters.

Typically, the skins are treated in this stage for a period of from 2 to 4 hours.

If desired, one may also incorporate synthetic resins such as acrylics, phenolics and aromatics at this stage. When using such resin impregnation, it may also be useful to incorporate in the bath inorganic salts, such as those of aluminum to assist in precipitation of the resin.

After completion of the second step of the tanning stage, the skins are washed with water for a period of no more than 25 minutes at ambient temperature.

After washing the skins are subjected to the final segment of my process. Prior to this, however, if it is desired to dye the product a dyeing step may be carried out. I have found aniline dyes at a concentration of 0.030 to 0.070 grams of aniline in an aqueous bath at a temperature above about 30° C. when used in the presence of a dilute acid, for example 3 to 6 percent formic acid to be particularly useful for this purpose.

The final portion of my process involves treatment of the skins in an aqueous bath at a temperature above 30° C., for example 35° to 40° C. Typically from 1 to 3.5 liters of water are used per kilogram of skins. If desired, the bath used for the dyeing stage may be employed. To the bath are successively added an anionic greasing agent (such as a sulfated or sulfited grease) typically in an amount of 0.085 to 0.115 grams per kilogram of fish skins and normally from 5 to 10 minutes later a synthetic or natural oil in an amount of typically from 0.008 to 0.015 grams per kilogram of fish skins. Subsequent to this, normally about 5 to 15 minutes after addition of the oil there is added to the bath an alkali metal salt of an organic acid, normally a weak acid such as formic acid, for example sodium formate. Typically, this salt is added in an amount of 0.003 to 0.006 grams per kilogram of fish skins. If desired, the treatment with the salt may be repeated after 5 to 10 minutes.

Finally, an alkaline material such as sodium bicarbonate should be added to the bath to act as a pH modifier gradually to raise the pH to above about 6 typically 6.5 to 7. I have found it useful to add such an alkali in three batches, each separated by about 5 to 15 minutes, typically adding from 0.003 to 0.006 grams of sodium bicarbonate per kilogram of fish skins in each batch.

Once the desired pH has been achieved, the skins should remain in a bath of tap water for 15 to 40 minutes and then removed and dried.

Those skilled in the art will readily appreciate that within the general parameters set out herein certain specific operations may be the most preferred for particular fish skins and that the process can be optimised for specific types of skin by routine experimentation within the guidelines herein set out.

The process of the invention will be illustrated by the following examples:

EXAMPLE 1

Stellifer Minor and Cillus Monti Tanning Process (Croader, weak fish)

This formula is for tanning each 1.000 grams of raw skin.

PHASE I (a) Three liters of tap water (b) 0.200 grams of common salt or sodium sulphate (c) 7–8.5 cc of formic acid at 85% concentration, or any other organic or inorganic acid (d) Formic acid must be dissolved in a 1 by 10 proportion with water (e) The combination of all elements before putting the raw skins in, must have a pH from 2.5 to a maximum of 3

(f) Leave the skins to rest in the solution 15 hours. The pH must result from a minimum of 3 to a maximum of 3.5

PHASE II

In this step, the skins must be desquamated, which can be done at hand or with appropriate machinery.

PHASE III (a) Three liters of tap water (b) 0.025 grams of TANESCO H (or a combination of cromium salt and condensed sulphonic aromatic acid) per each liter of water (c) Leave skins to rest 45 hours in the bath (d) Afterwards the skins must be washed in motion water between 30 to 35 minutes, at a temperature of 35 Celsius degrees

PHASE IV (a) Two liters of tap water at 35 Celsius degrees (b) 0.070 grams of TANESCO H (c) Leave skins for 4 hours on a motion bath (d) Wash skins in tap water no more than 30 minutes

PHASE V (a) Two liters of tap water at 40 Celsius degrees (b) 0.100 grams of INVASOL 8100 (or other anionic greased agent or any kind of sulphate or sulphited grease)

(c) 0.012 grams of INVASOL VR-12 (or other natural or sinthetic oil without chemical alteration). Leave skins in motion water for 15 minutes (d) 0.006 grams of sodium phormiate (or other organic acid). Leave skins in motion bath for 15 minutes (e) 0.006 grams of sodium phormiate (or other organic acid). Leave skins in motion bath for 15 minutes.

(f) 0.005 grams of sodium bicarbonate (or other alcali PH modifier) Leave skins in motion bath for 15 minutes (g) 0.005 grams of sodium bicarbonate (or other alcali PH modifier) Leave skins in motion bath for 15 minutes (h) 0.006 grams of sodium bicarbonate (or other alcali PH modifier) Leave skins in motion bath for 15 minutes (i) On finishing this treatment, the solution must result on a PH of 6.6 to a maximum of 7

(j) Leave skins on motion bath for 30 minutes.

(k) Take out skins form bath. Leave it dry.

EXAMPLE 2

Genypterus Tanning Process

Red Cusk Eel
Gilt Cusk Eel
Black Cusk Eel

This formula is for tanning each 1.000 grams of Genypterus raw skin.

PHASE I (a) Three liters of tap water (b) 0.180 grams of common salt or sodium sulphate (c) 7-8 cc of formic acid at 85% concentration, or any other organic or inorganic acid (d) Formic acid must be dissolved in a 1 by 10 proportion with water (e) The combination of all elements before putting the raw skins in, must have a PH of 2.5

(f) Leave the skins to rest in the solution 15 hours. The PH must result 3

PHASE II (a) Three liters of tap water (b) 0.025 grams of TANESCO H (or a combination of cromium salt and condensed sulphonic aromatic acid) per each liter of tap water (c) Leave skins to rest 36 hours in the bath (d) Afterwards the skins must be washed in tap water, between 15 and 20 minutes, at a temperature of 30 Celsius degrees

PHASE III (a) Two liters of tap water at 50 Celsius degrees (b) 0.070 grams of TANESCO H (c) Leave skins for 3 hours on a motion bath (d) Wash skins in tap water for 15 to 20 minutes

PHASE IV (a) Two liters of tap water at 35 Celsius degrees (b) 0.0100 grams of INVASOL 8100 (or other anionic greased agent or any kind of sulphated or sulphited grease)

(c) 0.012 grams of INVASOL VR-12 (or other natural or sinthetic oil without chemical alterations). Leave skins in motion bath for 10 minutes (d) 0.005 grams of sodium phormiate (or other organic acid). Leave skins in motion bath for 10 minutes (e) 0.005 grams of sodium phormiate (or other organic acid). Leave skins in motion bath for 10 minutes (f) 0.005 grams of sodium phormiate (or other organic acid). Leave skins in motion bath for 10 minutes (g) 0.005 grams of sodium bicarbonate (or any other alcali that act as a PH modifier). Leave skins in motion bath for 10 minutes (h) 0.005 grams of sodium bicarbonate (or any other alcali that act as a PH modifier). Leave skins in motion bath for 10 minutes (i) On finishing this treatment, the solution must result on a PH of 6.5

(j) Leave skins in motion bath during additional 20 minutes (k) Take out skins from bath. Leave it dry The fish skins tanned in accordance with these examples may be finished in the same manner as is used in existing leather finishing processes.

I claim:

1. A process for the production of tanned fish skins which comprises:

(a) contacting dry fish skins with an aqueous solution of a neutral salt said solution having a pH adjusted into the range 1.5 to 3.5, (b) subjecting said fish skins to a two step tanning operation wherein after said first tanning step said skins are washed at a temperature of not more than 35° C. and the second tanning step is carried out using a more concentrated solution than the first tanning step at a temperature of not less than 35° C. and (c) washing the tanned skins and treating them in an aqueous aqueous bath with an anionic grease and then an oil and then with an alkali metal salt of a weak organic acid followed by an alkali to raise the pH to at least 6.

2. A process according to claim 1 wherein there is used in each of said tanning steps a combination of a chromic salt and a syntan.

3. A process according to claim 2 wherein in the first of said tanning steps the chromic salt and syntan is used in a concentration of 0.018 to 0.032 grams/liters.

4. A process according to claim 3 wherein in the second of said tanning steps the chromic salt and syntan is used in a concentration of 0.050 to 0.090 grams per liter.

5. A process according to claim 2, 3 or 4, wherein said syntan is a sulfone syntan.

6. A process according to claim 2, 3 or 4, wherein said second tanning step is commenced at a temperature of not less than 50° C.

7. A process according to claim 1, wherein said first stage of the process, the skins are removed from the bath when it is at a pH of from 2 to 4.

8. A process according to claim 7, wherein the salt employed is sodium sulfate or sodium chloride and the pH is adjusted by addition of an organic acid.

9. A process according to claim 8 wherein said organic acid is formic acid.

10. A process according to claim 2 wherein in stage (a) of the process the salt employed is sodium sulfate or sodium chloride and the pH is adjusted by use of formic acid.

11. A process according to claim 1 wherein in stage (c) of the process the anionic grease employed is a sulfate or sulfited grease.

12. A process according to claim 11 wherein after addition of oil the alkali metal salt of a weak organic acid employed is sodium formate.

13. A process according to claim 12 wherein after addition of sodium formate there is added, as the said alkali, sodium bicarbonate.

14. A process according to claim 11, 12 or 13 wherein the final pH is in the range 6.5 to 7.

15. A process according to claim 11, 12 or 13 wherein prior to treatment with an aniomic grease the fish skins are treated with an aniline dye.

16. A process according to claim 1, 2, 3, 4, 7, 8, 9, 10, 11, 12 or 13 wherein said fish is a teleost fish.

17. A process according to claim 2, 7, 10 or 11 wherein said fish is of the order Percomorphi.

* * * * *